US007579996B2

(12) United States Patent
Kuramoto et al.

(10) Patent No.: US 7,579,996 B2
(45) Date of Patent: Aug. 25, 2009

(54) FOLDABLE BROADBAND ANTENNA AND METHOD OF USING THE SAME

(75) Inventors: Akio Kuramoto, Tokyo (JP); Takuji Mochizuki, Kanagawa (JP)

(73) Assignees: NEC Corporation, Tokyo (JP); NEC Electronics Corporation, Kanagawa (JP)

( * ) Notice: Subject to any disclaimer, the term of this patent is extended or adjusted under 35 U.S.C. 154(b) by 158 days.

(21) Appl. No.: 11/745,071

(22) Filed: May 7, 2007

(65) Prior Publication Data

US 2007/0268189 A1 Nov. 22, 2007

(30) Foreign Application Priority Data

May 17, 2006 (JP) ..... 2006-138061

(51) Int. Cl.
*H01Q 13/10* (2006.01)

(52) U.S. Cl. ..... 343/767

(58) Field of Classification Search ..... 343/700 MS, 343/702, 767, 897
See application file for complete search history.

(56) References Cited

U.S. PATENT DOCUMENTS

| | | | | |
|---|---|---|---|---|
| 4,367,475 | A | 1/1983 | Schiavone | |
| 6,218,997 | B1 * | 4/2001 | Lindenmeier et al. | 343/725 |
| 6,483,466 | B2 * | 11/2002 | Liu | 343/702 |
| 6,600,448 | B2 * | 7/2003 | Ikegaya et al. | 343/700 MS |
| 6,759,985 | B2 * | 7/2004 | Acher et al. | 343/700 MS |
| 6,917,333 | B2 * | 7/2005 | Ikegaya et al. | 343/700 MS |
| 2002/0011959 | A1 | 1/2002 | Liu | |
| 2004/0008146 | A1 | 1/2004 | Ikegaya | |

FOREIGN PATENT DOCUMENTS

| | | | |
|---|---|---|---|
| EP | 0637094 | A1 | 2/1995 |
| GB | 2373638 | A | 9/2002 |
| GB | 2416924 | A | 2/2006 |
| JP | S63-135003 | A | 6/1988 |
| JP | 2002-76757 | A | 3/2002 |
| JP | 2003-37431 | A | 2/2003 |
| JP | 2003-101334 | A | 4/2003 |

(Continued)

OTHER PUBLICATIONS

Korean Office Action issued in corresponding Korean Patent Application No. 10-2007-0047681, dated Mar. 25, 2008.

*Primary Examiner*—Tan Ho
(74) *Attorney, Agent, or Firm*—Sughrue Mion, PLLC

(57) ABSTRACT

The present invention provides a small, thin, and cheap foldable broadband antenna that is valid in a wide band and, moreover, can be manufactured at low cost, and a method of using the same. A foldable broadband antenna includes: a plate conductor having a rectangular outer shape and in which a slit is formed from a long side so as be orthogonal to a longitudinal direction; a side conductor provided perpendicularly from a side parallel with the slit in the plate conductor; and a back conductor disposed in parallel with the plate conductor from an end of the side conductor toward the slit. In the plate conductor, a coaxial external conductor of a coaxial cable is connected to the side opposite to the side conductor with the slit therebetween, and a coaxial central conductor of the coaxial cable is electrically connected to the same side as that of the side conductor.

17 Claims, 16 Drawing Sheets

FOREIGN PATENT DOCUMENTS

| | | | |
|---|---|---|---|
| JP | 2003-332834 | A | 11/2003 |
| JP | 2004-104333 | A | 4/2004 |
| JP | 3103091 | U | 5/2004 |
| JP | 2004-215132 | A | 7/2004 |
| JP | 2005-203830 | A | 7/2005 |
| WO | WO 02/039538 | A3 | 5/2002 |

* cited by examiner

PRIOR ART

FOLDABLE BROADBAND ANTENNA AND METHOD OF USING THE SAME

BACKGROUND OF THE INVENTION

1. Field of the Invention

The present invention relates to an antenna formed by a metal plate and a dielectric printed board and, more particularly, to a small-sized broadband antenna element and a method of using the same.

2. Description of the Related Art

In recent years, a TV reception antenna for digital terrestrial broadcasting and an antenna for a wireless TV using the UWB (Ultra Wide Band) technique require a very wide band.

For example, communications using the UWB technique is expected to use a frequency band of 3.1 GHz to 4.9 GHz.

There is a conventional broadband antenna having a structure as shown in FIG. 1. The antenna is disclosed in "plate antenna and television receiver having the antenna" of Japanese Patent Application Laid-Open No. 2005-203830 (document 1). A plate conductor 101 has a slit 102 on one side, and power is supplied through a coaxial cable 105.

Recent electronic devices such as a device having a USB interface have to be compact as typified by a USB (Universal Serial Bus) memory.

As a conventional technique related to miniaturization of an antenna, there is an antenna disclosed in "radio device" of Japanese Patent Application Laid-Open No. 2004-215132 (document 2).

The antenna disclosed in document 1 has a broadband characteristic but has a drawback of large dimensions. The dimensions are 210 mm×210 mm at the lowest useful frequency of 470 MHz, which are equivalent to "0.3 wavelength×0.3 wavelength". The dimensions do not satisfy the demand for miniaturization of an electronic device.

The invention disclosed in document 2 relates to a so-called notch antenna which hardly covers a broad band. Further, since the circuit board itself is folded, it is difficult to reduce the thickness and the high manufacturing cost due to folding of the circuit board occurs.

SUMMARY OF THE INVENTION

Disclosed herein are a small and thin foldable broadband antenna that covers a wide band and, moreover, can be manufactured at low cost and a method of using the same.

The foldable broadband antenna comprises a plate conductor having a slit, a back conductor that is electrically connected with the plate conductor and is disposed parallel to the plate conductor with space, wherein one of a pair of conductors composing a line spans the slit and is electrically connected with the plate conductor on a conductive route from the slit to the back conductor.

The present invention provides a small and thin foldable broadband antenna that is effective in a wide band and, moreover, is manufactured at low cost, and a method of using the same.

BRIEF DESCRIPTION OF THE DRAWINGS

Features of the disclosed embodiments will be described by way of the following detailed description with reference to the accompanying drawings in which.

DETAILED DESCRIPTION OF EXEMPLARY EMBODIMENTS

A foldable broadband antenna according to the present invention has a configuration that a slit 2 is formed on one end of the longitudinal direction of a plate conductor. A side conductor is added to one end orthogonal to the longitudinal direction and. further, a back conductor is added. By forming the plate conductor, the side conductor, and the back conductor by folding one metal plate, the antenna can be formed at low cost.

Power is supplied by a coaxial cable. A coaxial external conductor is electrically connected across the plate conductor on one side of a slit, and a coaxial central conductor is connected to the conductor on the other side of the slit. Consequently, a loop antenna that is effective within a wide band is formed by the plate conductor and the coaxial cable.

A similar power supply structure can be also formed electrically by using a printed board.

Exemplary embodiments of the invention will be described below with reference to the drawings.

First Embodiment

Figure 1:
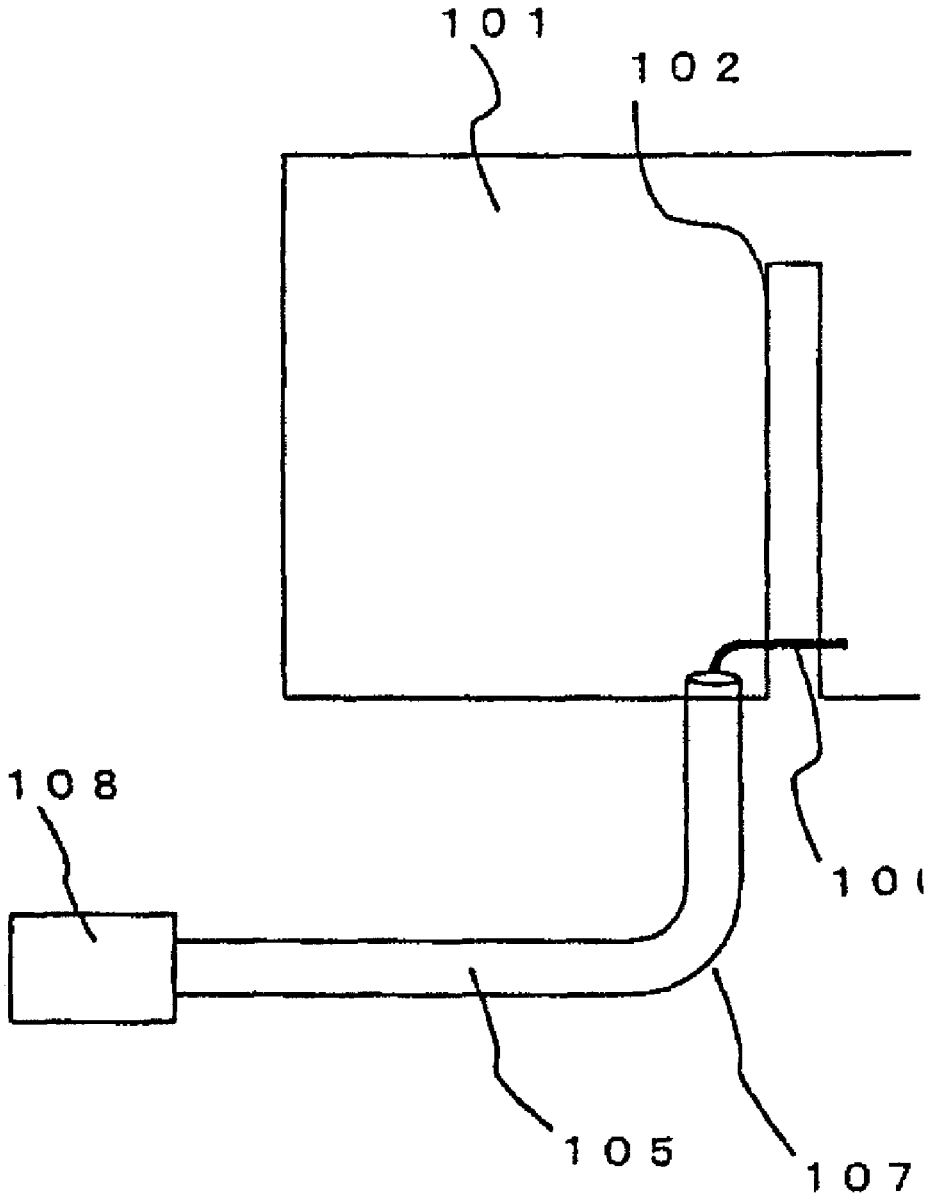
FIG. 1 is a diagram showing the configuration of a conventional antenna for a radio device.
Figure 2:
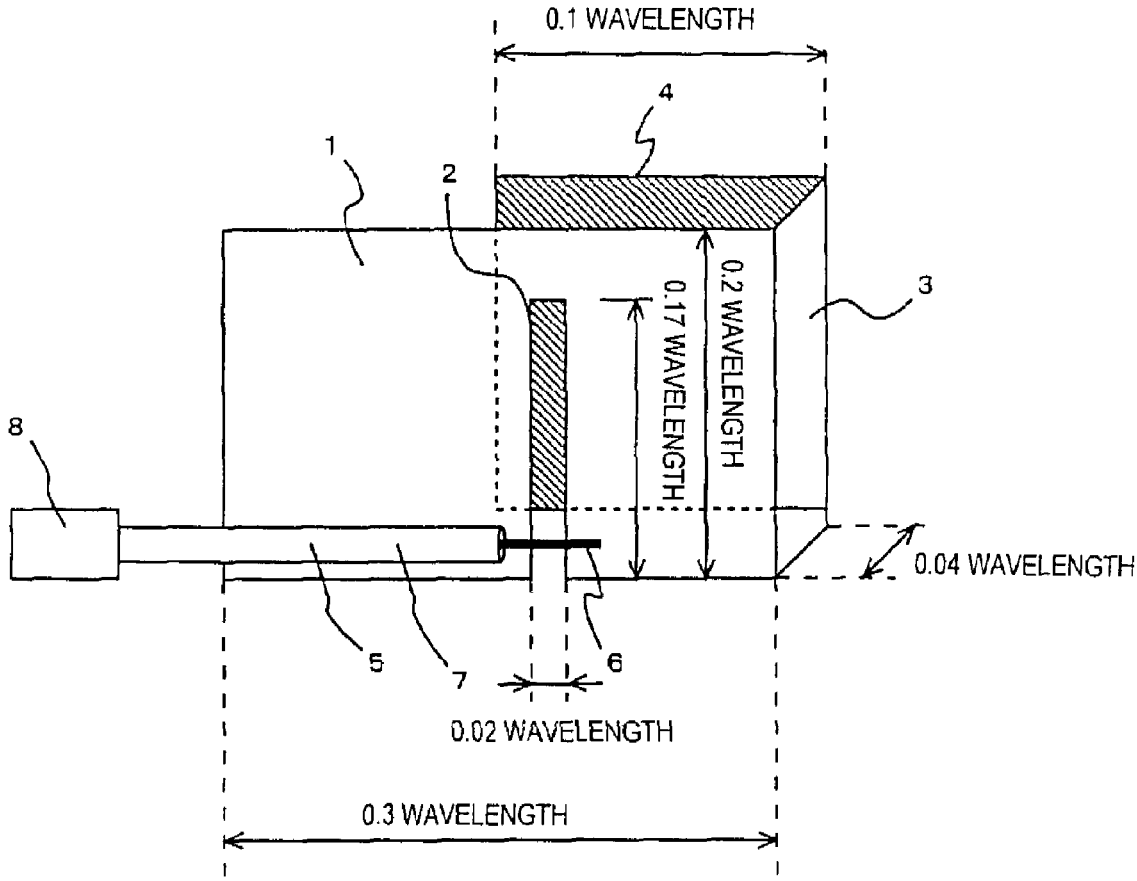
FIG. 2 is a diagram showing the configuration of a foldable broadband antenna according to a first exemplary embodiment.

FIG. 2 shows the configuration of a foldable broadband antenna according to the first embodiment. The foldable broadband antenna has a configuration that the slit 2 is formed at one side of the shorter direction (at one of long sides) of a plate conductor 1, a side conductor 3 is provided on one side of the longer direction (on one of short sides), and a back conductor 4 is added.

The width of the plate conductor 1 is about 0.2 wavelength of the lowest useful frequency. The depth of the slit 2 is 85% (0.17 wavelength) of the width of the plate conductor 1. The width of the slit 2 is about 0.02 wavelength of the lowest useful frequency.

The length of the plate conductor 1 in the longer direction is about 0.3 wavelength of the lowest useful frequency. The length of the side conductor 3 is about 0.04 wavelength, and the length of the back conductor 4 is about 0.1 wavelength.

The plate conductor 1, the side conductor 3, and the back conductor 4 are formed from one metal plate, so that the manufacture cost can be reduced.

Power is supplied via a coaxial cable 5. A coaxial external conductor 7 is electrically connected (by soldering or the like) across the plate conductor 1 on one side of the slit 2, and a coaxial central conductor 6 is electrically connected (by soldering or the like) to a conductor part on the other side of the slit 2. The coaxial external conductor 7 is soldered across the plate conductor 1 to come in front of the slit 2.

Although the coaxial cable 5 is attached onto a front surface of the plate conductor 1, not facing the back conductor 4, in FIG. 2, the coaxial capable 5 may be connected to a reverse surface of the plate conductor 1, facing the back conductor 4.

Figure 3:
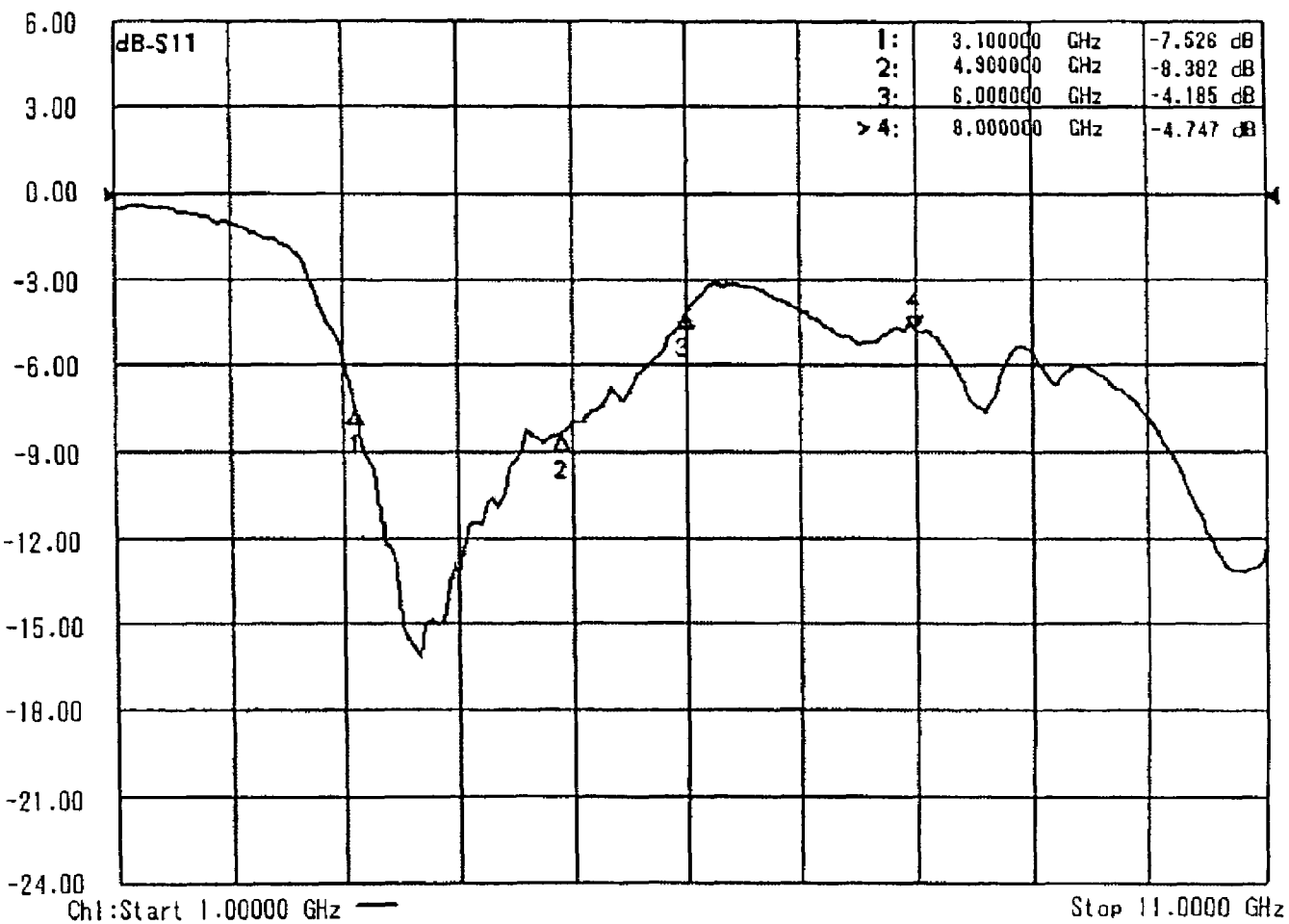
FIG. 3 is a diagram showing the return loss of the foldable broadband antenna.

FIG. 3 shows an example of a return loss characteristic of the foldable broadband antenna of the first embodiment. The width is 30 mm, the length is 20 mm, the width of the back conductor is 11 mm, the width of the side conductor is 4 mm, the length of the slit is 17 mm, and the width of the slit is 2 mm.

Within a target bandwidth of 3.1 GHz to 4.9 GHz, a return loss of 7.5 dB or less (VSWR 2.5 or less) is obtained. The antenna has sufficient performance in the target bandwidth.

As described above, when the target bandwidth is 3.1 GHz to 4.9 GHz, the antenna having approximately 20 mm in length, 30 mm in width, and 4 mm in height can present desired antenna characteristics. In this case, the size is 0.2×0.3×0.04 in wavelength equivalent, so that the area of the antenna can be reduced to about ⅔ of that of the conventional technique (document 1).

Since the circuit board itself is not bent, the antenna is thinner than that disclosed in document 2.

Further, since the bandwidth of 470 MHz to 620 MHz has been used conventionally, the normalized bandwidth is about 28%. In the embodiment. the antenna can be used from 3.1 GHz to 4.9 GHz, so that the normalized bandwidth is about 45%.

As described above, the foldable broadband antenna of the first embodiment can effectively operate in the bandwidth that is twice as wide as that of the conventional technique.

Second Embodiment

Figure 4:
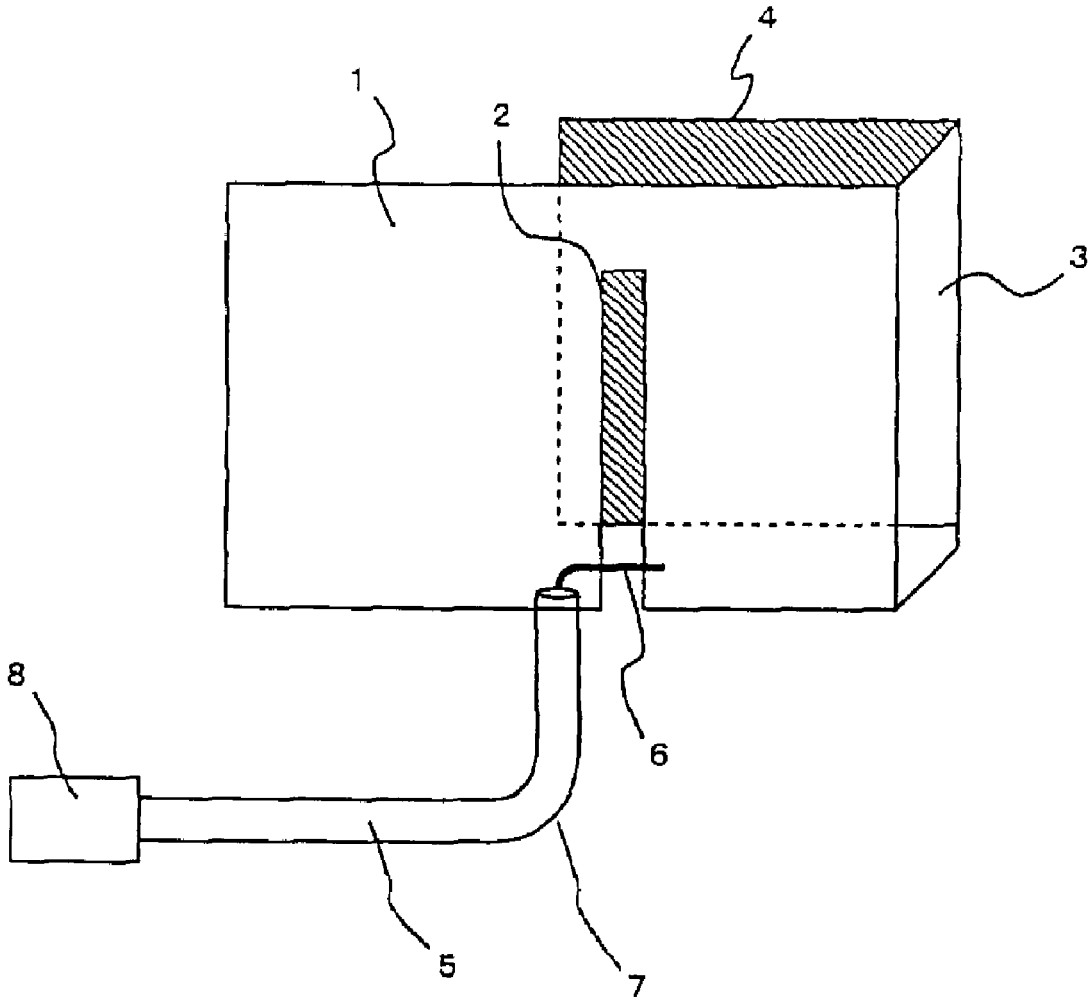
FIG. 4 is a diagram showing the configuration of a foldable broadband antenna according to a second exemplary embodiment.

FIG. 4 shows the configuration of a foldable broadband antenna according to the second embodiment. The foldable broadband antenna has the configuration almost similar to that of the first embodiment except for the method of connecting the coaxial cable 5.

As shown in FIG. 4, only an end (upper end) of the coaxial external conductor 7 of the coaxial cable 5 is soldered near the slit 2 on the plate conductor 1, thereby forming a loop antenna.

In the first embodiment, the coaxial external conductor 7 and the plate conductor 1 are in line-contact. In the second embodiment, they are in point-contact. Also in this configuration, effects similar to those of the foldable broadband antenna of the first embodiment are obtained.

Since the other configuration is similar to the first embodiment, repetitive description is omitted.

Third Embodiment

Figure 5:
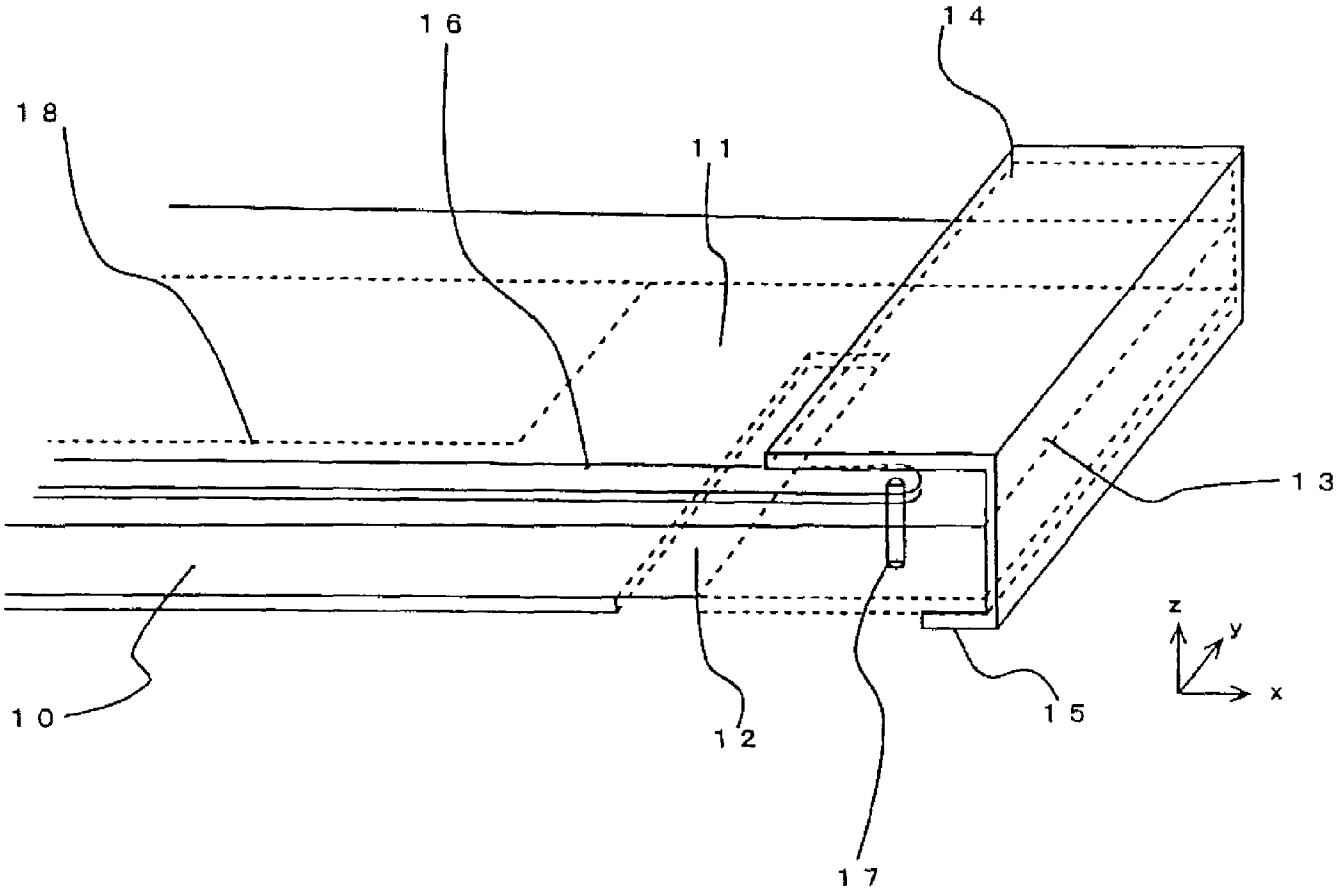
FIG. 5 is a top perspective view of a foldable broadband antenna according to a third exemplary embodiment.
Figure 6:
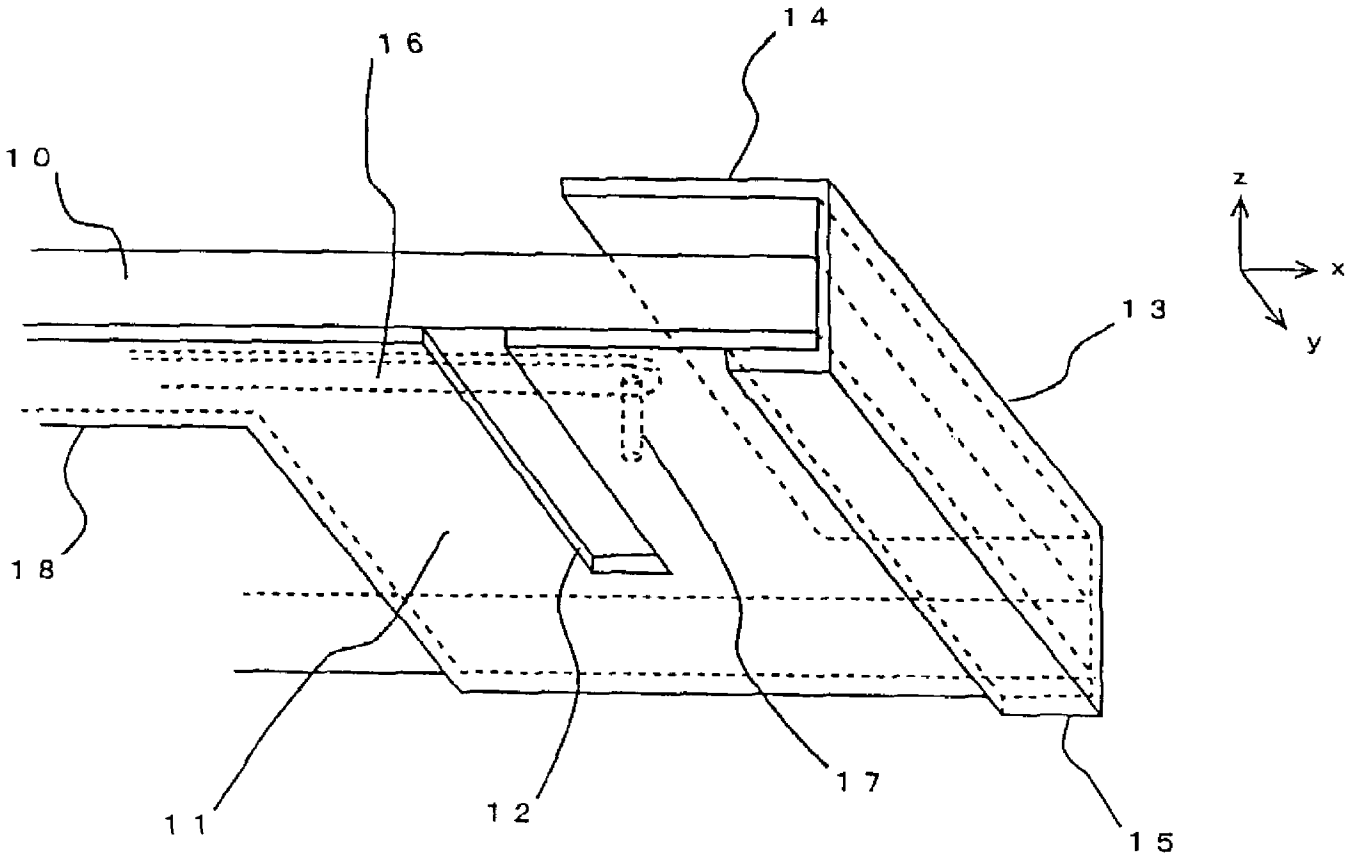
FIG. 6 is a bottom perspective view of a foldable broadband antenna.
Figure 7:
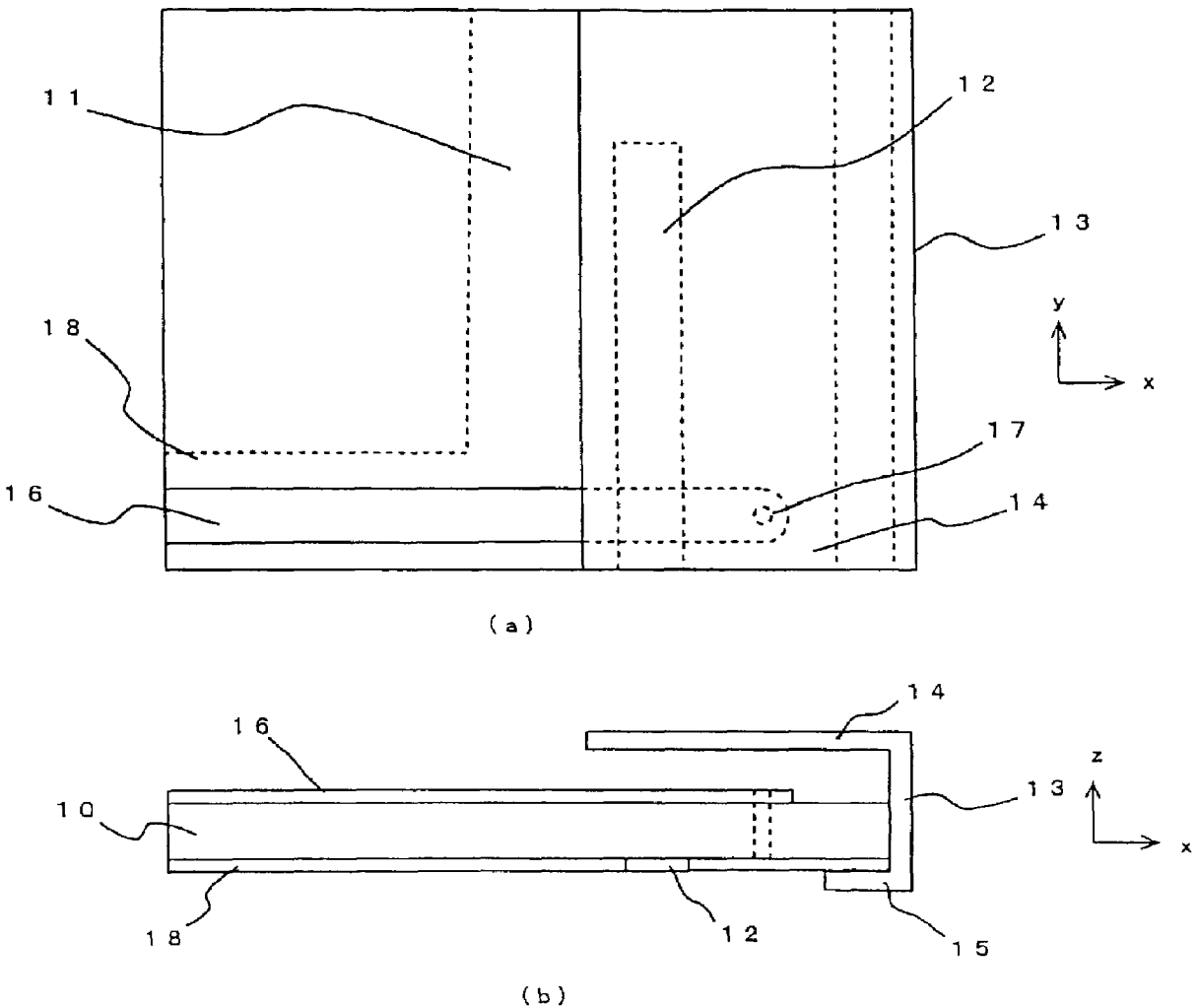
FIG. 7A is a top view of the foldable broadband antenna.
FIG. 7B is a side view of the foldable broadband antenna.

FIG. 5 is a top perspective view of a foldable broadband antenna according to the third embodiment. FIG. 6 is a bottom perspective view of the foldable broadband antenna. FIGS. 7A and 7B are top view and side view, respectively, of the foldable broadband antenna.

The foldable broadband antenna is constructed using a printed board 10. First, a plate conductor 11 formed by a copper foil pattern is disposed on the bottom surface of the printed board 10. A slit 12 is formed in the plate conductor 11 in a manner similar to the first embodiment. At one end (the right end in FIG. 5) of the short side of the plate conductor 11, a conductor having a U shape in cross section formed by a surface conductor 15, a side conductor 13, and a back conductor 14 is disposed.

In the conductor having the U shape in cross section, the surface conductor 15 is electrically connected (by solder or the like) to the end of the plate conductor 11.

Power is supplied via a microstrip line 16. The microstrip line 16 disposed on the top surface of the printed board 10 and a ground 18 disposed on the bottom face of the printed board 10 function as a microstrip transmission line. Both of the microstrip line 16 and the ground 18 are formed as copper foil patterns on the printed board 10.

The tip of the microstrip line 16 extends over the slit 12 and is connected to the plate conductor 11 via a conductive through hole 17. The plate conductor 11 and the microstrip lines form a loop antenna.

Since the power supply structure is equivalent to that of the first embodiment from an electrical viewpoint, similar effects are obtained.

Fourth Embodiment

Figure 8:
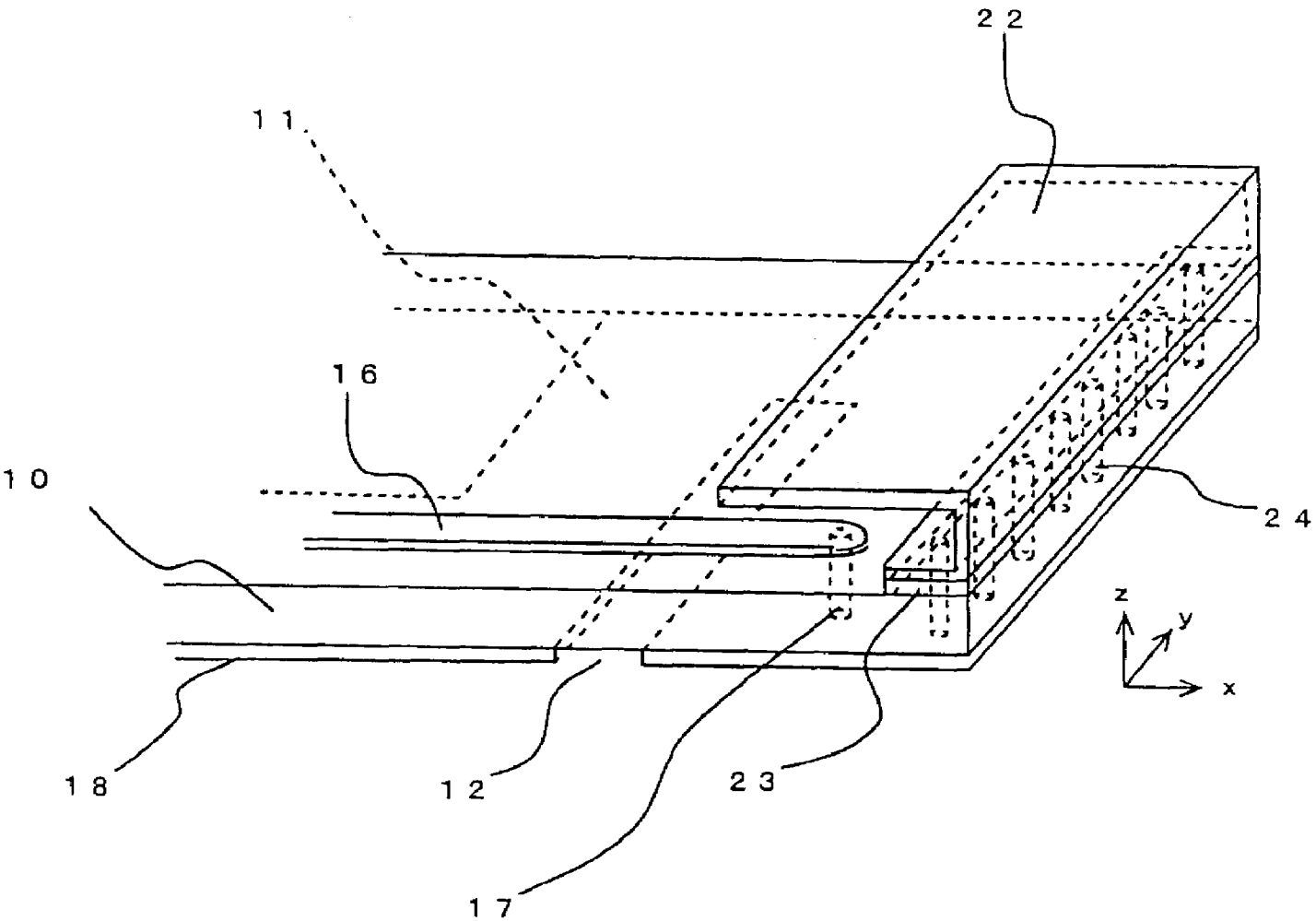
FIG. 8 is a top perspective view of a foldable broadband antenna according to a fourth exemplary embodiment.
Figure 9:
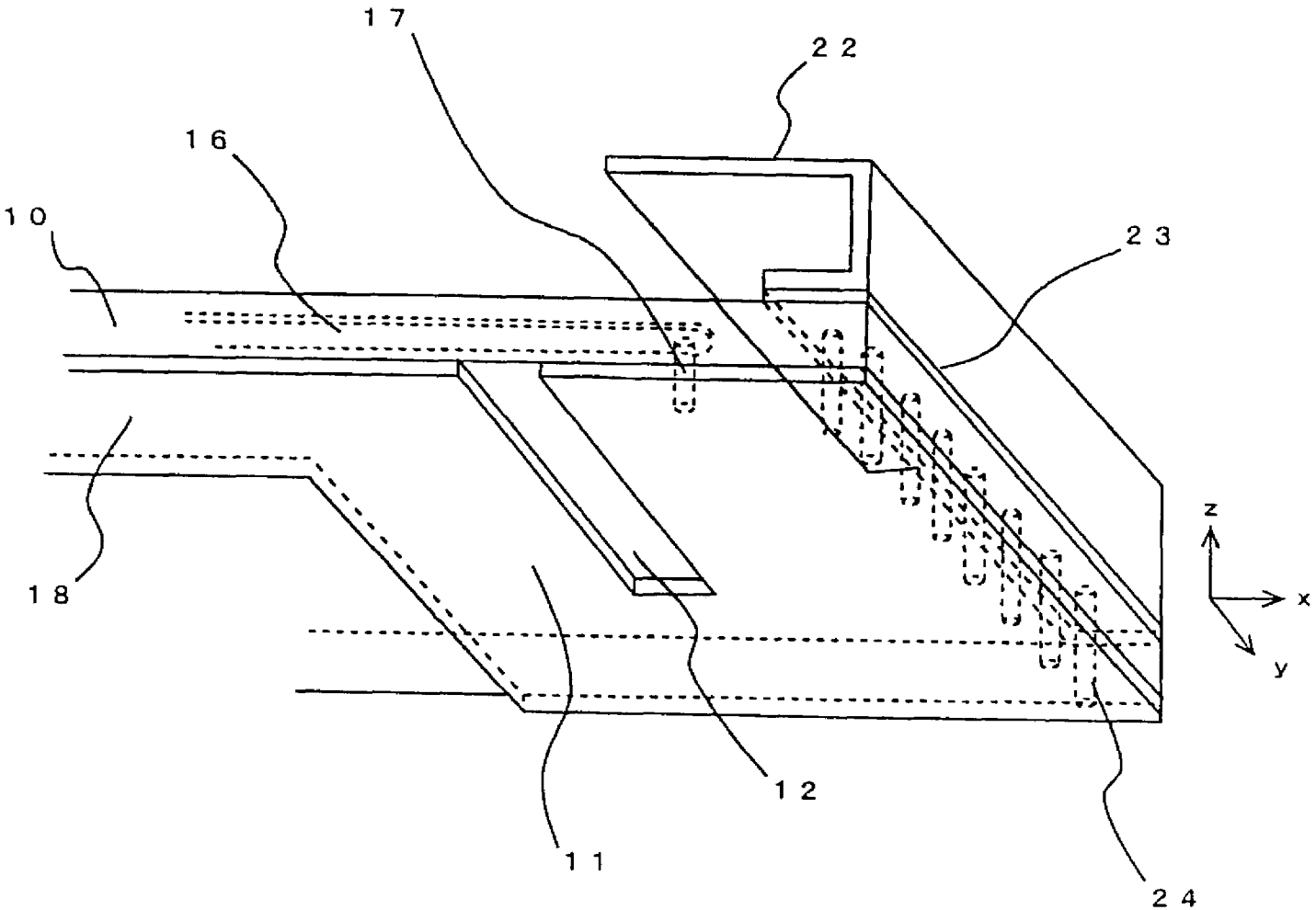
FIG. 9 is a bottom perspective view of the foldable broadband antenna.
Figure 10:
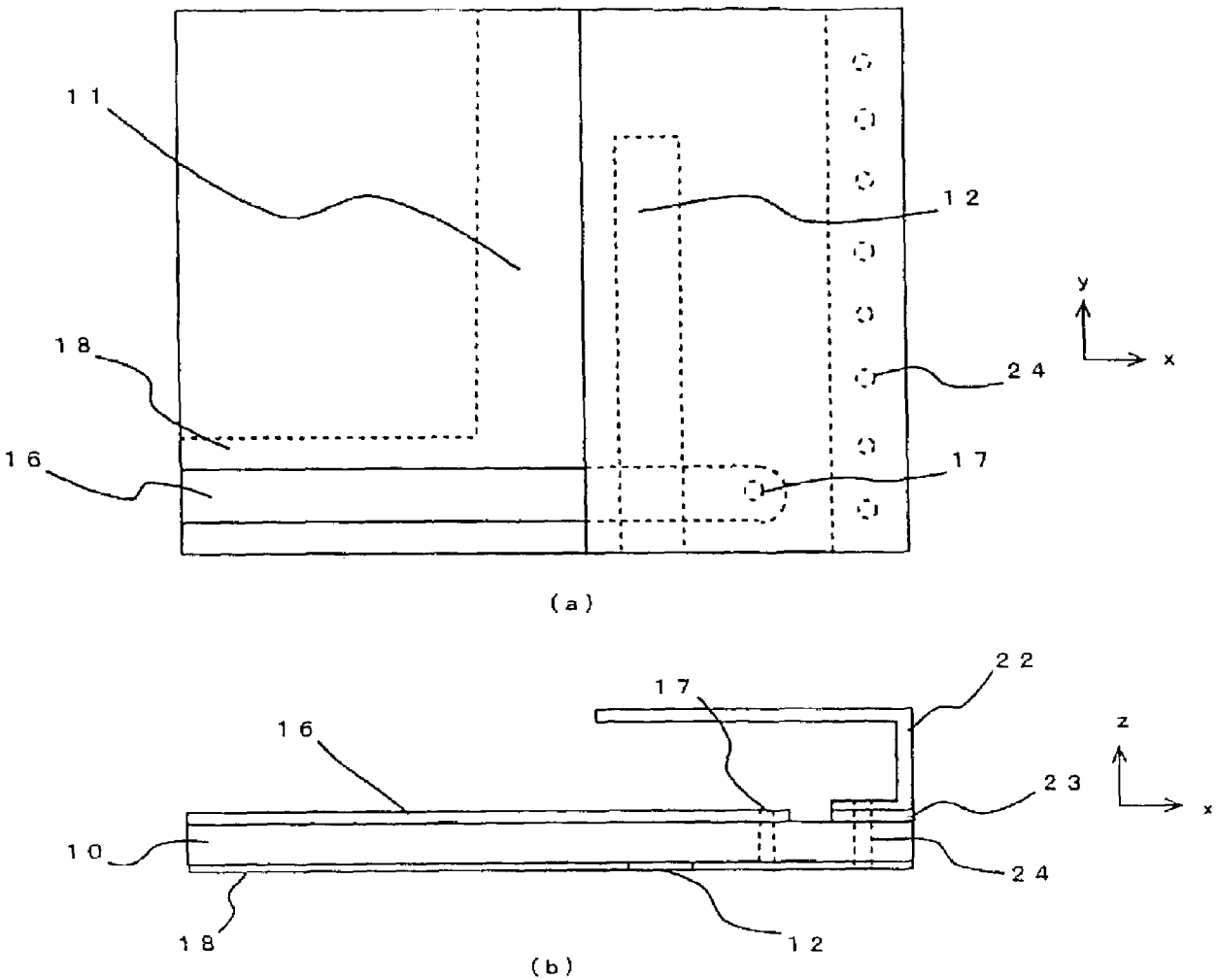
FIG. 10A is a top view of the foldable broadband antenna.
FIG. 10B is a side view of the foldable broadband antenna.

FIG. 8 is a top perspective view of a foldable broadband antenna according to the fourth embodiment. FIG. 9 is a bottom perspective view of the foldable broadband antenna. FIGS. 10A and 10B are top view and plan view, respectively, of the foldable broadband antenna.

The fourth embodiment is different from the third embodiment in that a conductor is constructed using back conductors 22 and 23 and through holes 24 in place of the conductor having the U shape (the conductor formed by the surface conductor 15, the side conductor 13, and the back conductor 14).

The back conductor 22 is a conductor having a U shape. Part of the back conductor 22 is soldered to the back conductor 23 formed by a copper foil pattern on the printed board. Further, the back conductor 23 is electrically connected to the end of the plate conductor 11 through a plurality of conductive through holes 24. When the width of connection between the back conductors 22 and 23 is small, the structure is equivalent to that of the third embodiment from an electrical viewpoint, so that similar effects are obtained.

Fifth Embodiment

Figure 11:
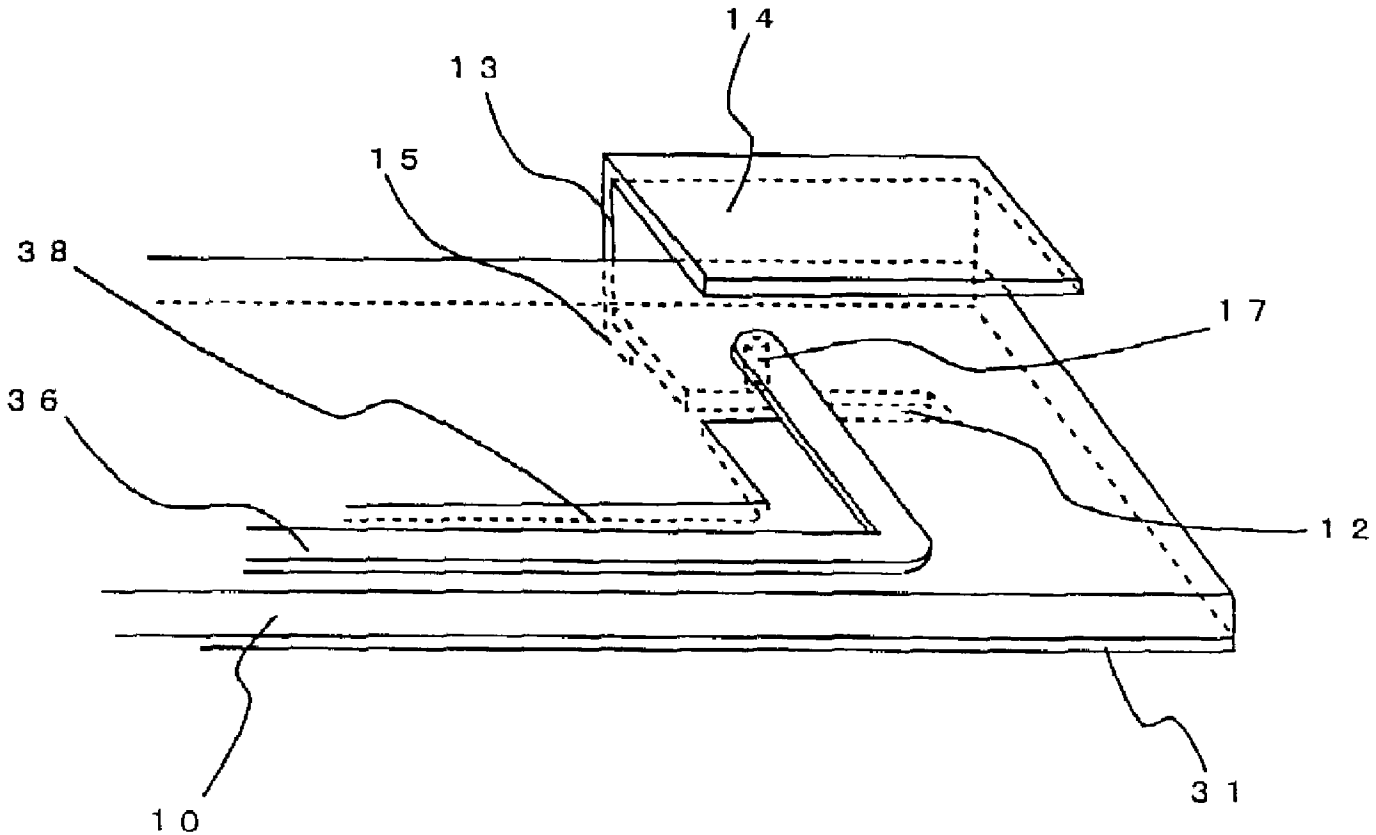
FIG. 11 is a top perspective view of a foldable broadband antenna according to a fifth exemplary embodiment.

FIG. 11 shows the configuration of a foldable broadband antenna according to the fifth embodiment. The foldable broadband antenna has a configuration similar to that of the case where the orientation of the slit 12 in the third embodiment is turned by 90 degrees. A plate conductor 31 corresponds to the plate conductor 11 in the third embodiment.

In a manner similar to the third embodiment, power is supplied via a microstrip transmission line formed by a microstrip line 36 and a ground 36. Since the orientation of the slit 12 is turned by 90 degrees, the microstrip line 36 is also turned by 90 degrees in this embodiment, and is electrically connected to the plate conductor 31 via the through hole 17 immediately after spanning the slit 12.

Since the foldable broadband antenna of the fifth embodiment is equivalent to the third embodiment from an electrical viewpoint, similar effects are obtained.

Sixth Embodiment

Figure 12:
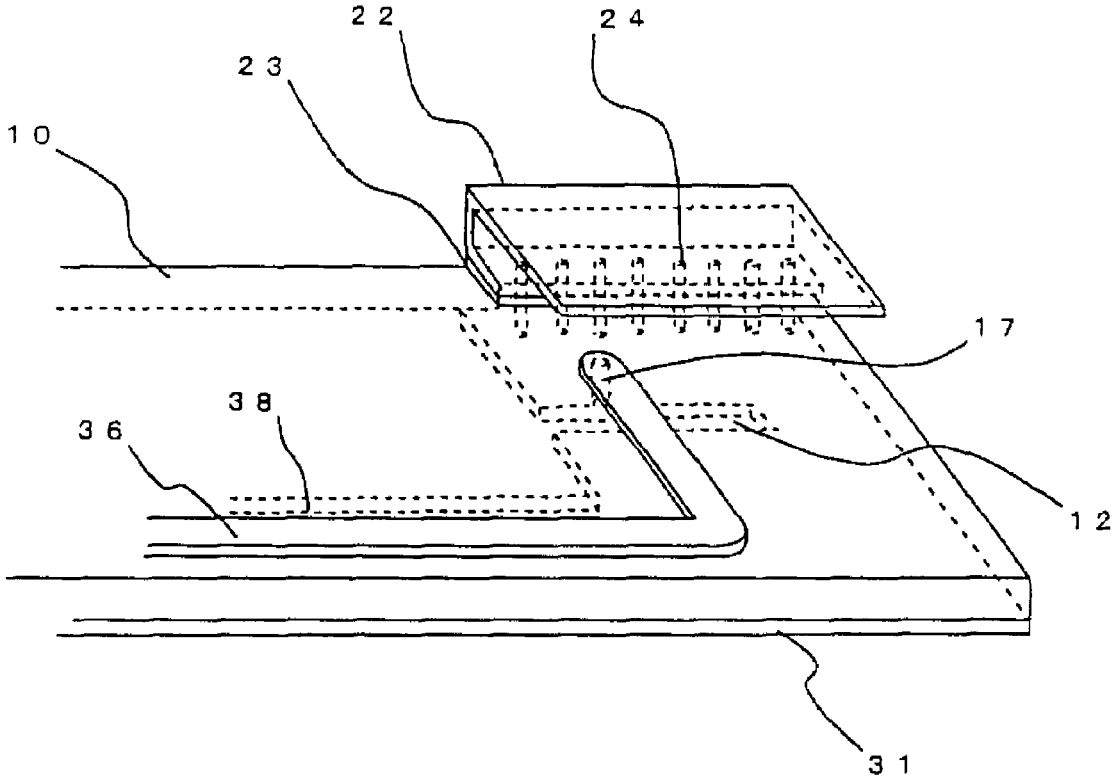
FIG. 12 is a top perspective view of a foldable broadband antenna according to a sixth exemplary embodiment.

FIG. 12 shows the configuration of a foldable broadband antenna according to the sixth embodiment. The foldable broadband antenna has a configuration similar to that of the case where the orientation of the slit 12 in the fourth embodiment is turned by 90 degrees. The plate conductor 31 corresponds to the plate conductor 11 in the fourth embodiment.

In a manner similar to the fourth embodiment, power is supplied via a microstrip transmission line formed by a microstrip line 36 and a ground 38. Since the orientation of the slit 12 is turned by 90 degrees, the orientation of the microstrip line 36 is also turned by 90 degrees.

Since the foldable broadband antenna of the sixth embodiment is equivalent to the fourth embodiment from an electrical viewpoint, similar effects are obtained.

Seventh Embodiment

Figure 13:
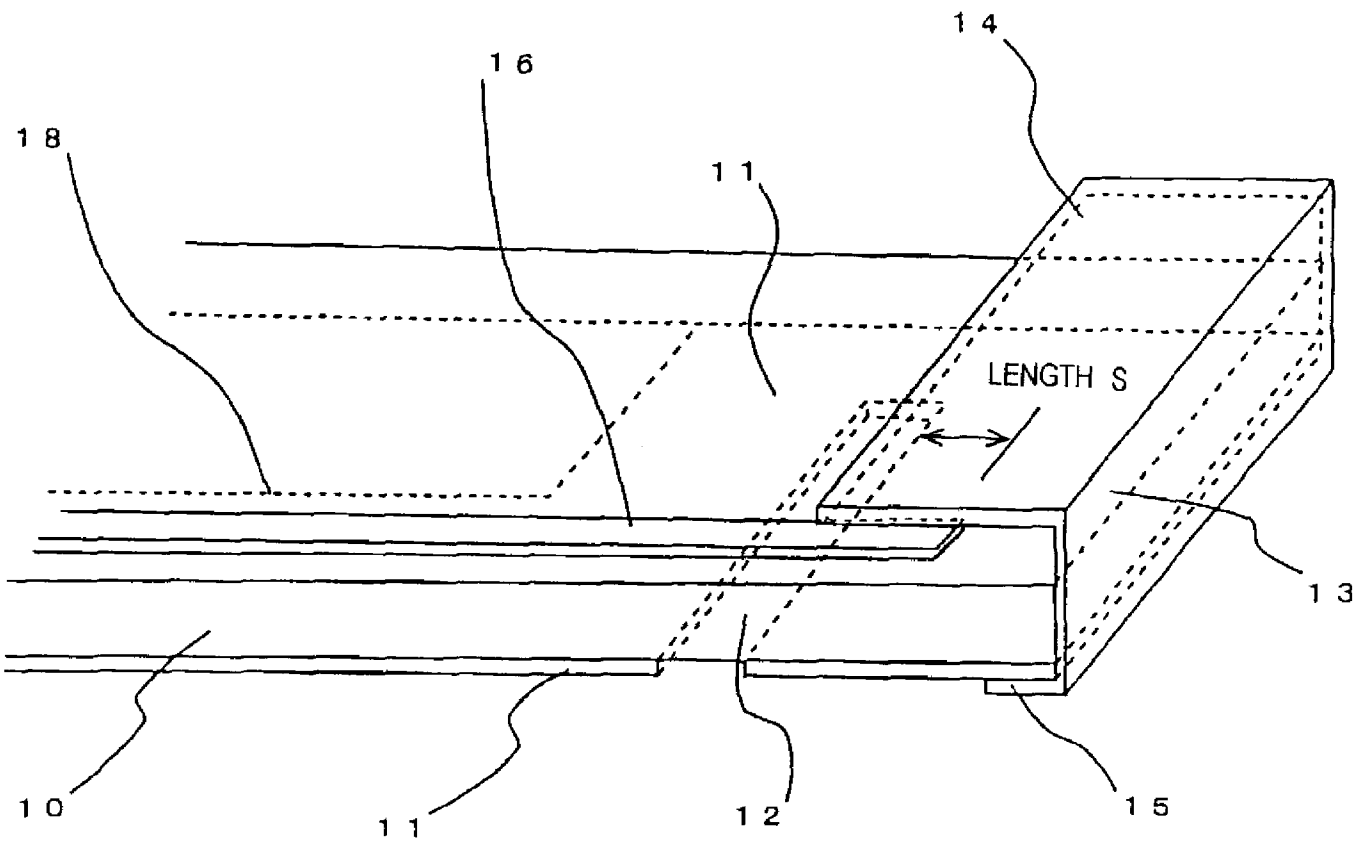
FIG. 13 is a top perspective view of a foldable broadband antenna according to a seventh exemplary embodiment.

FIG. 13 shows the configuration of a foldable broadband antenna according to the seventh preferred embodiment. The foldable broadband antenna has a configuration similar to that of the third embodiment but differs from the third embodiment in that the through holes are not provided.

By adjusting the shape and size of one end of the microstrip line 16 and the length S of the projecting part of the line 16 from the slit 12, impedance match is obtained.

Figure 14:
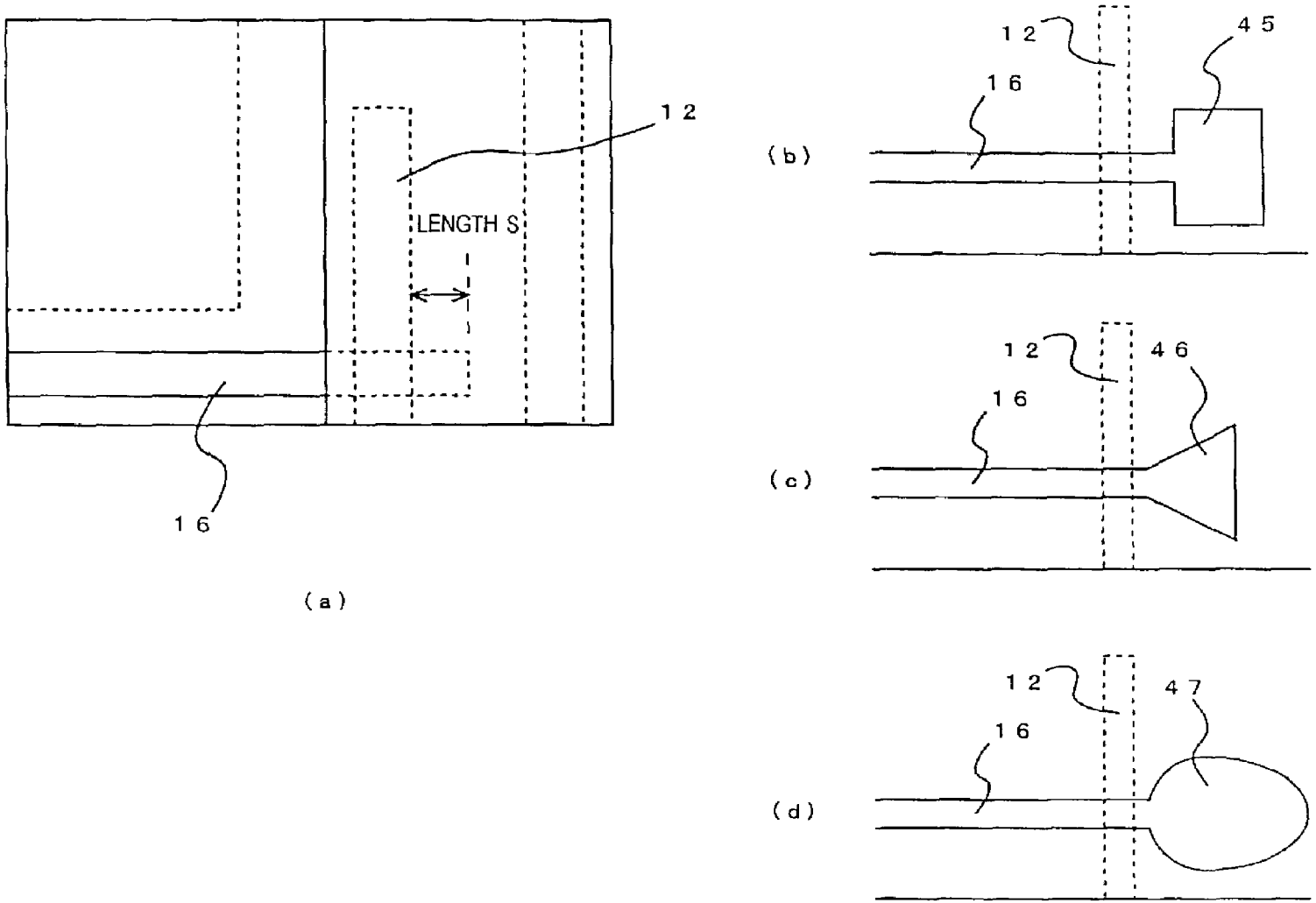
FIG. 14A is a top view of the foldable broadband antenna.
FIGS. 14B, 14C, and 14D are diagrams showing examples of the shape of a connecting part.

FIGS. 14A to 14D show configuration examples of a power feeding part. FIG. 14A is a top view, and FIGS. 14B, 14C, and 14D show modifications of the tip portion of the microstrip line 16. FIG. 14B shows a square tip portion 45, FIG. 14C shows a triangle tip portion 46, and FIG. 14D shows an ellipse tip portion 47. By adjusting the length S and the shape and size of the tip portion, impedance match can be obtained. The shape of the tip portion of the microstrip line 16 may be different from any of those shown in the figures. As long as a desired antenna characteristic is obtained, any shape can be adopted.

Eighth Embodiment

Figure 15:
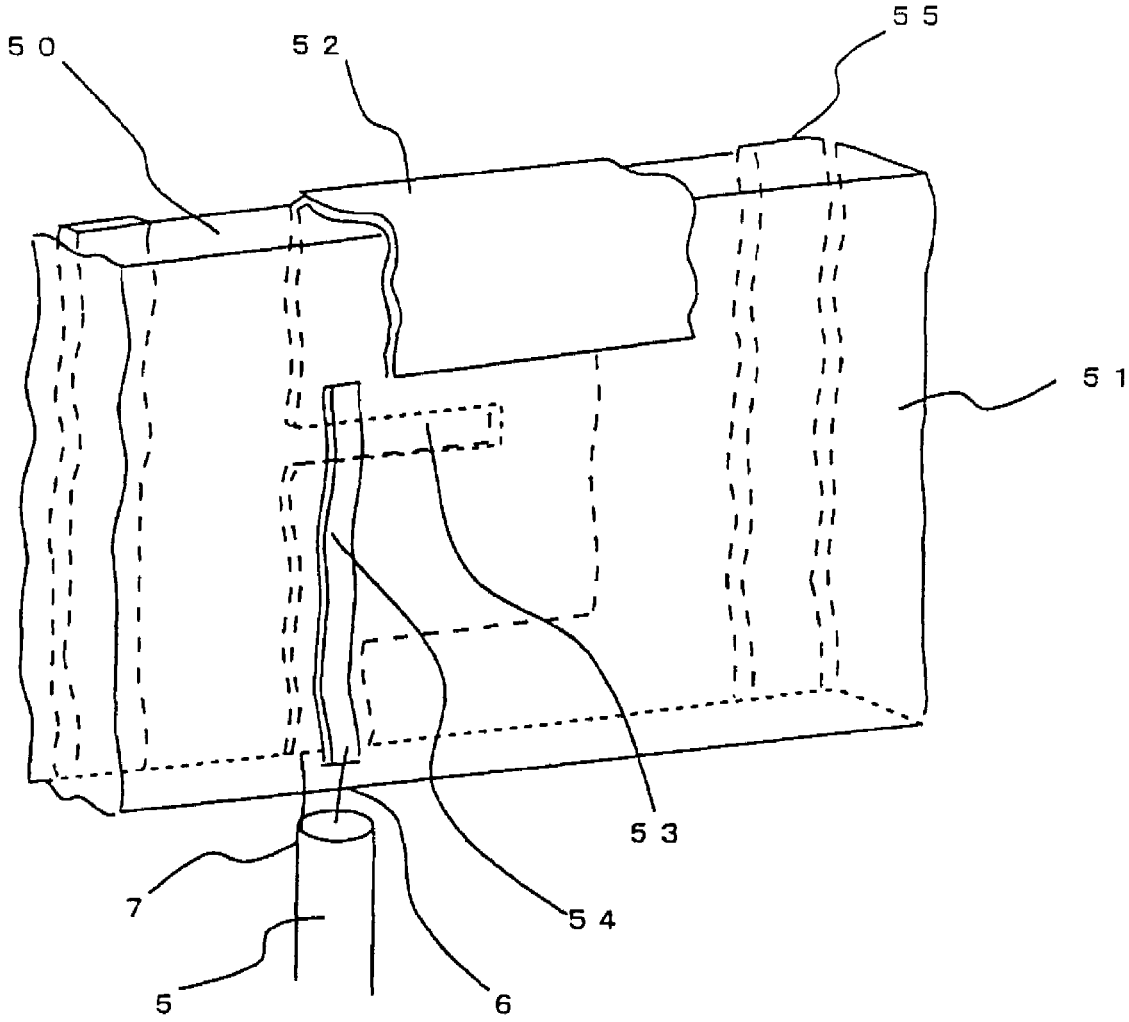
FIG. 15 is a diagram showing the configuration of a foldable broadband antenna according to an eighth exemplary embodiment.

FIG. 15 shows the configuration of a foldable broadband antenna of the eighth embodiment. The foldable broadband antenna is similar to that of the seventh embodiment but is constructed by using an insulator 51 in place of the printed board 10.

A plate conductor 52 having a slit 53 is disposed at the rear side of the insulator 51, and an end of the plate conductor 52 is folded back to the front side of the insulator 51. On the front of the insulator 51, a bar-shaped conductor 54 is disposed so as to cross the slit 53. A coaxial central conductor 6 of the coaxial cable 5 is electrically connected to the bar-shaped conductor 54, and the coaxial external conductor 7 is electrically connected to the plate conductor 52.

The insulator 51 is a foldable insulator such as cloth, sponge, film, or FPC (flexible printed circuit board). A soft antenna 50 has such as velcro (registered trademark) straps 55 on the back, and it can be attached to clothes, bags, or the like.

Figure 16:
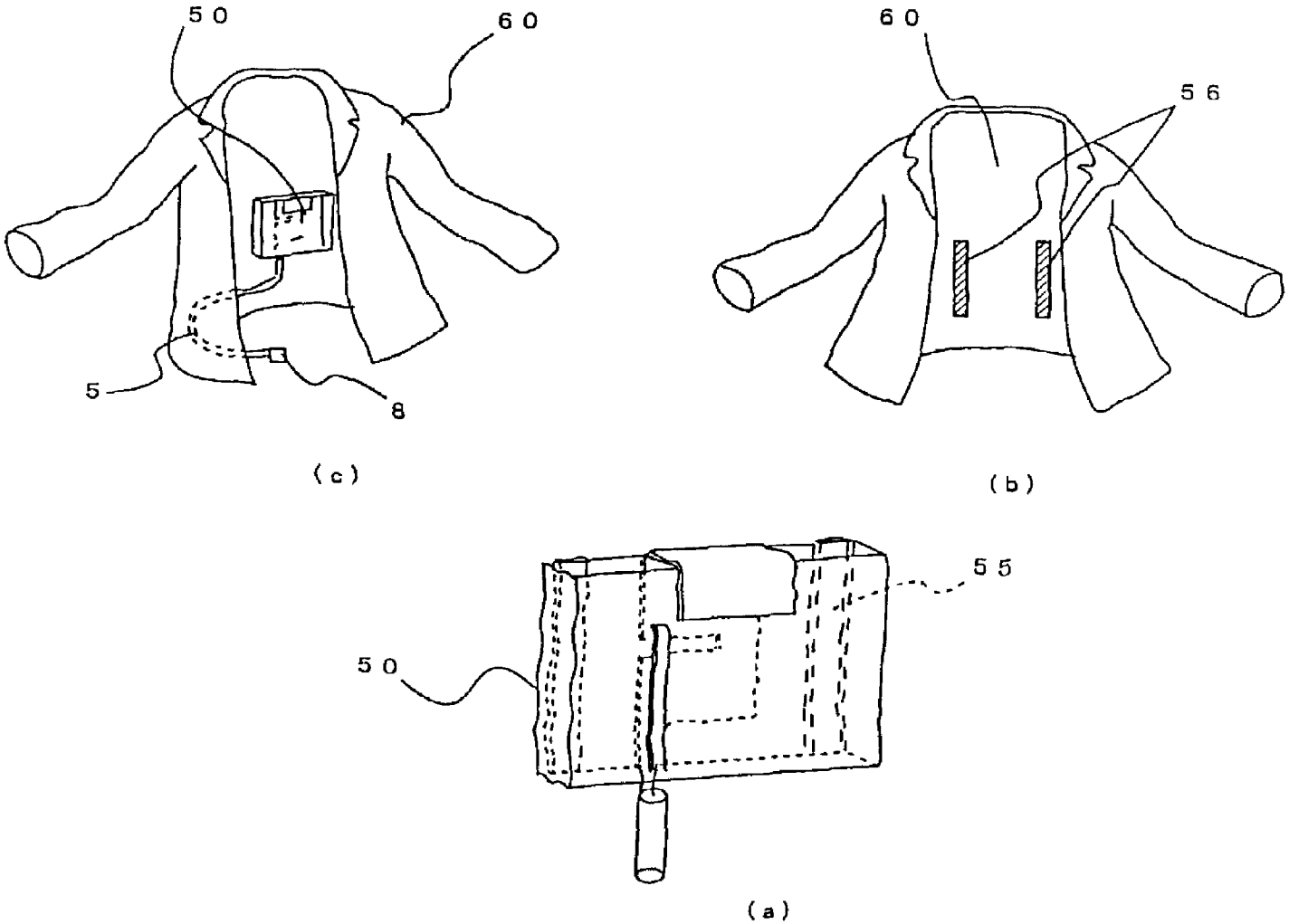
FIGS. 16A, 16B, and 16C are diagrams showing an antenna, clothes to which the antenna is attached, and clothes to which the antenna is attached, in an example of using the foldable broadband antenna.

FIGS. 16A, 16B, and 16C show a use example of the foldable broadband antenna of the embodiment. The soft antenna 50 with a velcro (registered trademark) straps 55 in FIG. 16A and clothes 60 with a velcro (registered trademark) straps 56 in FIG. 16B provide the soft antenna 50 attached to the wear 60 in FIG. 16C. In such a manner, for example, the soft antenna 50 for receiving digital terrestrial broadcasting or the like is carried as the antenna 50 is attached to the clothes 60. By connecting the soft antenna 50 to an antenna terminal of a portable terminal, users can view the broadcasting in an excellent reception state.

Ninth Embodiment

The foldable broadband may further include a side conductor rising perpendicularly from a side parallel to the slit. The plate conductor has a rectangular outer shape where a slit is formed from a long side. The back conductor extends from a side of the side conductor in parallel with the plate conductor. One end of a line is electrically connected to one side of the slit, opposite to the side conductor, and the other end of the line is electrically connected to the other side of the slit.

Tenth Embodiment

The line may be a coaxial cable. A coaxial external conductor of the coaxial cable may be electrically connected to one side of the slit, opposite to the side conductor, and a coaxial central conductor of the coaxial cable may be electrically connected to the other side of the slit.

Eleventh Embodiment

The coaxial external conductor may be electrically connected at one point to the plate conductor.

Twelfth Embodiment

The coaxial external conductor may be electrically connected in line contact with the plate conductor.

Thirteenth Embodiment

The plate conductor, the side conductor, and the back conductor may be integrally formed by folding a single conductive plate.

Fourteenth Embodiment

The plate conductor may be provided on one surface of a printed board. The back conductor may be disposed on the other side of the printed board and in parallel with the printed board with space left between the back conductor and the printed board. The line may be a microstrip line forming a microstrip transmission line with the plate conductor on the surface of the printed board opposite to the plate conductor. The microstrip line and the plate conductor may be electrically connected via a first through hole in a position closer to the back conductor than the slit.

Fifteenth Embodiment

The back conductor, a side conductor and a surface conductor may be connected and form an almost U shape where the surface conductor is electrically connected to the plate conductor so as to cover part of the printed board.

Sixteenth Embodiment

A rear conductor may be disposed on the other side of the printed board. The back conductor may form part of a U-shaped conductor that is on the rear conductor. The plate conductor and the rear conductor may be electrically connected via a second through hole.

Seventeenth Embodiment

The slit may be formed in the same direction as a longitudinal direction of the printed board.

Eighteenth Embodiment

The plate conductor may be provided on a surface of an insulator. A conductor having an almost U shape may be obtained by connecting a surface conductor, the back conductor and a side conductor so as to cover part of the insulator. A power supply conductor that crosses the slit on a surface of the insulator opposite to the plate conductor may form the line.

Nineteenth Embodiment

A sheet of conductor is bent, and the plate conductor and the conductor having an almost U shape may be integrally formed from the sheet of conductor.

Twentieth Embodiment

The insulator, the plate conductor and the conductor having an almost U shape may have flexibility.

Twenty-First Embodiment

The insulator may be provided with an attaching means for being attached to another member.

Twenty-Second Embodiment

The insulator may be a printed board. The power supply conductor may be disposed on a surface opposite to the plate conductor, and be a microstrip line that forms a microstrip transmission line with the plate conductor.

Twenty-Third Embodiment

A return loss adjusting part may be formed by enlarging an end of the microstrip line.

Twenty-Fourth Embodiment

A method may be provided for using the foldable broadband antenna where the insulator may be provided with an attaching means for being attached to another member. The foldable broadband antenna is attached to clothes by using the attaching means.

The foregoing embodiments are exemplary embodiments of the invention and the invention is not limited to the embodiments.

For example, although the configuration of using the coaxial cable for power supply has been described in the foregoing embodiments, similar effects can be also obtained by using a line having another structure such as a twist pair cable.

It is to be appreciated that those skilled in the art can change or modify the embodiments without departing from the scope and spirit of the present invention.

What is claimed is:

1. A foldable broadband antenna comprising:

a plate conductor having a slit with an open end disposed at an edge of the plate conductor, the slit having a length of 0.17 wavelength or less;

a back conductor that is electrically connected with the plate conductor and is disposed parallel to the plate conductor with space, wherein one of a pair of conductors composing a line spans the slit and is electrically connected with the plate conductor at a position on the plate conductor adjacent the open end of the slit on a conductive route from the slit to the back conductor, and wherein the other of the pair of conductors contacts the plate conductor at an edge of the slit.

2. The foldable broadband according to claim 1, comprising:

a side conductor rising perpendicularly from a side parallel to the slit, wherein the plate conductor has a rectangular outer shape where a slit is formed from a long side;

the back conductor extends from a side of the side conductor in parallel with the plate conductor; and one end of the line is electrically connected to one side of the slit, opposite to the side conductor, and the other end of the line is electrically connected to the other side of the slit.

3. The foldable broadband antenna according to claim 2, wherein pair of conductors is a coaxial cable, a coaxial external conductor of the coaxial cable is electrically connected to one side of the slit, opposite to the side conductor, and a coaxial central conductor of the coaxial cable is electrically connected to the other side of the slit.

4. The foldable broadband antenna according to claim 3, wherein the coaxial external conductor is electrically connected at one point to the plate conductor.

5. The foldable broadband antenna according to claim 3, wherein the coaxial external conductor is electrically connected in line contact with the plate conductor.

6. The foldable broadband antenna according to claim 2, wherein the plate conductor, the side conductor, and the back conductor are integrally formed by folding a single conductive plate.

7. A foldable broadband antenna comprising:

a plate conductor having a slit and provided on one surface of a printed board;

a back conductor that is electrically connected with the plate conductor and is disposed on the other side of the printed board and in parallel with the plate conductor with space and in parallel with the printed board with space left between the back conductor and the printed board;

wherein a microstrip line forms a microstrip transmission line with the plate conductor on the surface of the printed board opposite to the plate conductor and spans the slit and is electrically connected with the plate conductor via a first through hole on a conductive route from the slit to the back conductor in a position closer to the back conductor than the slit.

8. The foldable broadband antenna according to claim 7, wherein the back conductor, a side conductor and a surface conductor are connected and form an almost U shape where the surface conductor is electrically connected to the plate conductor so as to cover part of the printed board.

9. The foldable broadband antenna according to claim 7, wherein:

a rear conductor is disposed on the other side of the printed board;

the back conductor forms part of a U-shaped conductor that is on the rear conductor;

the plate conductor and the rear conductor are electrically connected via a second through hole.

10. The foldable broadband antenna according to claim 7, wherein the slit is formed in the same direction as a longitudinal direction of the printed board.

11. A foldable broadband antenna comprising:

a plate conductor having a slit and provided on a surface of an insulator;

a back conductor that is electrically connected with the plate conductor and is disposed parallel to the plate conductor with space;

a conductor having an almost U shape obtained by connecting a surface conductor, the back conductor and a side conductor so as to cover part of the insulator; and a power supply conductor that spans the slit on a surface of the insulator opposite to the plate conductor and is electrically connected with the plate conductor on a conductive route from the slit to the back conductor.

12. The foldable broadband antenna according to claim 11, wherein a sheet of conductor is bent, and the plate conductor and the conductor having an almost U shape are integrally formed from the sheet of conductor.

13. The foldable broadband antenna according to claim 12, wherein the insulator is provided with an attaching means for being attached to another member.

14. A method of using the foldable broadband antenna of claim 13, wherein the foldable broadband antenna is attached to clothes by using the attaching means.

15. The foldable broadband antenna according to claim 11, wherein the insulator, the plate conductor and the conductor having an almost U shape have flexibility.

16. The fordable broadband antenna according to claim 11, wherein:

the insulator is a printed board; and the power supply conductor is disposed on a surface opposite to the plate conductor, and is a microstrip line that forms a microstrip transmission line with the plate conductor.

17. The foldable broadband antenna according to claim 16, wherein a return loss adjusting part is formed by enlarging an end of the microstrip line.

* * * * *